US005823562A

United States Patent [19]

Stubblefield

[11] Patent Number: 5,823,562

[45] Date of Patent: Oct. 20, 1998

[54] SNOWBOARD

[75] Inventor: Donald P. Stubblefield, Beaverton, Oreg.

[73] Assignee: North Shore Partners, Lake Oswego, Oreg.

[21] Appl. No.: 918,906

[22] Filed: Aug. 27, 1997

[51] Int. Cl.[6] ..... A63C 5/04

[52] U.S. Cl. ..... 280/609; 280/602; 280/14.2; 441/68; D21/766

[58] Field of Search ..... 280/602, 609, 280/14.2, 601, 28; 441/68; D21/760, 766

[56] References Cited

U.S. PATENT DOCUMENTS

| | | | |
|---|---|---|---|
| 3,260,532 | 7/1966 | Heuvel | 280/602 |
| 4,676,521 | 6/1987 | Monreal | 280/609 X |
| 4,974,868 | 12/1990 | Morris | 280/609 |
| 5,275,428 | 1/1994 | Bejean et al. | 280/602 |
| 5,556,123 | 9/1996 | Fournier | 280/607 |
| 5,573,264 | 11/1996 | Deville et al. | 280/602 |
| 5,667,238 | 9/1997 | Sarver | 280/609 |

*Primary Examiner*—J. J. Swann
*Assistant Examiner*—Michael Mar
*Attorney, Agent, or Firm*—Saidman DesignLaw Group

[57] ABSTRACT

A snowboard is disclosed having two cambers centered, respectively, below each of the two boot mounting zones.

7 Claims, 2 Drawing Sheets

SNOWBOARD

BACKGROUND OF THE INVENTION

1. Field of The Invention

This invention relates to a snowboard, i.e., a single board intended to be ridden by a skier having both feet positioned on the board while gliding on snow.

2. Description of Related Art

Snowboarding is a sport which evolved from skiing. It is not surprising, therefore, that the technology involved in snowboarding also was derived from skiing. Snowboards were initially manufactured by ski manufacturers, and most of the initial designers of snowboards were therefore ski designers who understandably borrowed heavily from the accepted wisdom of the ski industry. As a consequence, there are many similarities today between skis and snowboards, which is reasonable, since both skis and snowboards are designed for travel over snow. For example, both skis and snowboards use essentially the same materials combined in essentially the same way. They both started with all wood constructions, and then introduced synthetic materials, e.g., fiberglass ultra high molecular weight polyethylenes, either singly or in laminated combinations with wood cores, steel edges, and plastic tops and sidewalls. Also, the techniques of manufacture were transferred virtually unchanged from skis to snowboards.

The similarities between skis and prior art snowboards are significant, from the perspective of the present invention, namely, the provision of a single camber in the snowboard.

FIG. 1 illustrates the concept of camber—the upward arching of the ski—as it is applied to prior art and present day skis. As shown, ski 10 has a top 12 and a base 14 joined by lateral sides 16 (only one being visible). Longitudinally, ski 10 comprises a nose 18, a central section 20, and a tail 22. Nose 18 is upturned to facilitate the forward gliding of the ski over the surface of the snow. If nose 18 were flat, it would dig into the snow and cause the skier to fall. The end of tail 22 is essentially flat, since the ski is not intended to glide in that direction. Central section 20 of ski 10 is arched upwardly, forming camber 24. The maximum height of camber 24 above the surface 26 of the snow 28 is greatly exaggerated in FIG. 1. Because of the camber 24, ski 10 usually rides on snow 28 only along two areas 30 and 32 of base 14. Camber 24 allows ski 10 to have a certain amount of fore-and-aft flexibility which provides the skier with a better feel for the ski's contact with snow 28. Camber 24 is also important to the steering of the skis by the skier shifting his/her weight, causing more or less of edge 16 to be loaded changing the deflection of the ski. Finally, because of camber 24, ski 10 looks and acts like a leaf spring, that is, it provides critical storage and release of energy as the skier jumps, lands, and traverses uneven terrain.

As is well known, only one foot, represented in FIG. 1 by boot 34, is supported more or less centrally by each ski 10. Thus, ski 10 has but a single input for forces applied to the ski, namely, through boot 34. Having a single camber 24, the distribution of those forces within the ski, and therethrough to the interaction of ski and snow, is straightforward and direct. As a result, the responses of the ski to the forces applied by the skier are predictable, and thereby controllable and reproducible. A balanced weight distribution places equal pressures on riding areas 30 and 32; forward shifts place most of the weight on arcuate riding area 30 adjacent nose 18; and rearward weight shifts place most of the weight on flat riding area 32 adjacent tail 22. Each elicit a different response from the ski. Even though much of learning to ski consists of learning which weight shift results in which response the ski will give, learning how to control the ski is relatively simple, because each ski has only a single input acting on a single camber.

FIG. 2 illustrates how prior art snowboards have incorporated ski design features therein. Snowboard 50 has a top 52, a base 54, and lateral sides 56. Longitudinally, snowboard 50 comprises a nose 58, a central section 60, and a tail 62. Both nose 58 and tail 62 are upturned to facilitate gliding of the snowboard in either direction over the surface of the snow. Although snowboard 50 is intended to glide forwardly over the snow, it is recognized that at times it does in fact glide backwards, so for the protection of the snowboarder, tail 62 is also upturned. Some snowboards have flat tails, like ski 10, but they are in the minority and are not illustrated but would benefit from the present invention.

Like ski 10, central section 60 of snowboard 50 is arched upwardly by a single, centrally located camber 64. As in FIG. 1, the maximum height of camber 64 above the surface 66 of the snow 68 is greatly exaggerated in FIG. 2. Because of camber 64, snowboard 50 usually touches snow 68 only along two arcuate riding areas 70 and 72 of base 54. Camber 64 is just as necessary to snowboard 50 as camber 24 is to ski 10 in that it allows snowboard 50 to have fore-and-aft flexibility which provides a better feel for the snow 68, better control of the snowboard by shifts in the skier's weight, and effective shock absorption.

Unlike ski 10, where a single boot 34 is attached to top 12, a pair of boots 74 and 76 are attached to top 52 of snowboard 50 in two extended mounting zones 78 and 80. As is well known in the art, each boot is secured by bindings which are threadedly attached to internally threaded inserts recessed into top 52.

Attaching both feet to one board instead of to two separate boards was a major difference as compared to skis, but as radical as this difference was, it does not seem to have occurred to anyone to question the desirability of including only one camber. One camber worked well for a ski, so it was assumed, apparently, it would work equally well for a snowboard. The system, however, is no longer a single input acting more or less centrally on a single camber. The system has become a pair of inputs acting separately and asymmetrically on a single camber.

The asymmetry is not only in the boots being widely spaced from the apex of the single arch of camber 24. Mounting zones 78 and 80 are designed such that boots 74 and 76 can intentionally be fixed in different locations therewithin. Mounting zones 78 and 80 are extended, as mentioned, and include a multitude of threaded inserts, which are usually arranged in patterns, some distinctive of the manufacturer, which permit small groupings of them to be used at any one time. Thus, the bindings, and thereby boots 74 and 76, can be fastened to top 52 in a variety of longitudinal and transverse placements on the snowboard. Naturally, changing the placements of the boots changes their asymmetry relative to camber 64.

Angular adjustments of the bindings relative to the snowboard is also made available by clamping circular flanges on the bindings between circular plates and top 52. Changing the angular orientations of the boots relative to snowboard 50 also changes the asymmetry, and thereby, the responses of snowboard 50 to variations in weight shifts.

Consider the responses of the snowboard 50 to the separate forces applied independently to the single camber 64.

Control of snowboard 50 is accomplished by weight shifts which changes the deflection of snowboard 50 existing at any given instant with respect to the snow 68. The amount of deflection affects how the snowboard will react. For example, the sharpness of a turn will depend upon how deeply snowboard 50 has deflected along the snow. The more deflection, and consequently the smaller the radius of curvature, the sharper the turn. The performance of the snowboard depends not only on the amount of deflection experienced, however, but also how the drag forces are distributed over the surfaces of the snowboard.

When the snowboarder shifts his/her weight from one foot to the other longitudinally of the snowboard, the longitudinal flexure of the snowboard is affected, which in turn affects the way the snowboard glides over the snow. If more of the weight's force is applied forwardly toward nose 58, the forward portion of camber 24 will flatten more than the back portion, digging the forward half of edge 56 more into snow 68. If more of the weight's force is applied rearwardly toward tail 62, the rearward portion of camber 24 will flatten more than the front portion, digging the rearward half of edge 56 more into snow 68. The feel of the snowboard changes as the weight distribution changes.

By leaning forwardly and backwardly along the length of the snowboard, the snowboarder changes the transverse distribution of weight on the snowboard which changes the local deformation of snowboard 50 relative to surface 66 of snow 68, causing snowboard 50 to turn. As the board changes local deflection, the radius of curvature is also changed. By leaning forwardly more weight is distributed on the forward section of snowboard 50, causing the front of the board to deflect into a curve with a smaller radius of curvature local to the front. The smaller radius of curvature in the front causes the front of snowboard 50 to dig into the turn and drives the snowboard into a tighter turn. Shifting the rider's weight backwardly along the length of the board causes the back to deflect into a tighter radius. The tighter radius of curvature in the back in turn causes the back of snowboard 50 to skid through the turn.

Thus far, only a broad sketch of how a snowboard is controlled has been drawn. It embodies changes which are intentionally, and hopefully controllably, imposed upon the snowboard. Because of the single arch, however, small differences in weight shift can produce large results. The size of riding area 70 actually touching surface 66 increases with increased weight being applied to boot 74. The amount it increases is not in direct proportion to the weight applied, however. The same is true for the other weight shifts already discussed. The responses are virtually unpredictable. A good snowboarder with lots of experience has a better feel for how snowboard 50 will respond, but even so, there are no guarantees that what is expected is what is received. The uncertainties are exacerbated, when snowboard 50 responds without a noticeable input. Unintentional responses are principally derivable from the single camber 64 of snowboard 50.

When a snowboarder rides a snowboard, because of side cuts and one central camber 64, the central section 60 is the last to make contact with the snow and often does not fully make contact. This variation in the strength and duration of contact in the central section 60 causes chatter during turns. Chatter is the acoustics response to the momentary and variable loading of the central section 60. Since the chatter is located in the central section 60 and away from the boots 74 and 76, the force multiplied by the distance from the chatter to the boots causes torques into the boots and feet of the rider. These torques are complex and variable, reducing the "feel" of the rider and snowboard. These torques and vibrations affect the stability and controllability of snowboards with a single camber, like snowboard 50.

There is nothing the snowboarder can do. Chatter is unintentional, cannot be controlled or duplicated, and is solely a function of the structure of the board. It makes the snowboard that much harder to ride. It is not surprising that a considerable amount of athletic abililty is required to be even a competent snowboarder. In order to minimize unintentional vibrations in their snowboards, board manufacturers stiffen the boards, as by the thickening of the central section of the board, but these measures inherently reduce the number of moves the snowboarder can make, diminishing their creative riding potential.

OBJECTS AND SUMMARY OF THE INVENTION

The present invention overcomes the difficulties described above by providing a snowboard with a plurality of cambers, preferably two, with at least one camber under each boot mounting zone. Two cambers result in three riding areas being spaced along the bottom of the snowboard. Since each camber is located under each boot mounting zone, the effect of chatter is reduced because chatter occurs at the top of the camber. This will reduce if not eliminate the torques as the distance from the chatter to the boot area is very small, if not zero. This virtually eliminates the unintentional vibrations and their adverse effects. This construction provides many advantages not enjoyed by prior art snowboards, as will be more apparent after a detailed description of the invention.

It is an object of the invention to provide a snowboard with two cambers, one camber under each boot mounting zone.

It is a further object of the invention to provide a snowboard with three riding areas being spaced along the bottom of the snowboard.

It is a further object of the invention to provide a snowboard which virtually eliminates deleterious vibrations caused by chatter in the snowboard. s It is a further object of the invention to provide a snowboard with separate, independent controls from each foot of the snowboarder.

It is a further object of the invention to provide a snowboard with increased control.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENT

Figure 1:
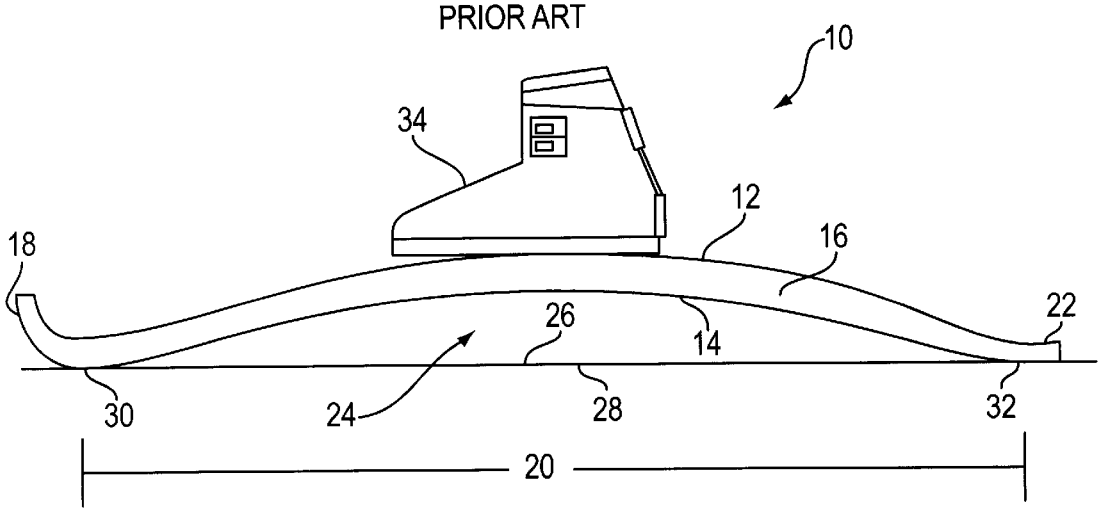
FIG. 1 PRIOR ART
FIG. 1 is a diagrammatic side view illustrating a prior art ski.

Referring to FIGS. 3–6, snowboard 100 comprises a top surface 102, a base surface 104, and sides 106. Sides 106 are inwardly curved, as most clearly seen in FIGS. 4 and 5, known in the art as side cuts.

Longitudinally from front to back, snowboard 100 includes a nose 108, a central section 110, and a tail portion 112; central section 110 extends longitudinally between and is joined with nose portion 108 and tail 112 by arcuate riding areas or forward and rearward base surfaces 114 and 116, respectively, which are adapted to come into contact with the riding surface 124 during use by the user. Nose 108 and tail 112 are both upturned to facilitate gliding in their respective directions over the snow.

Figure 3:
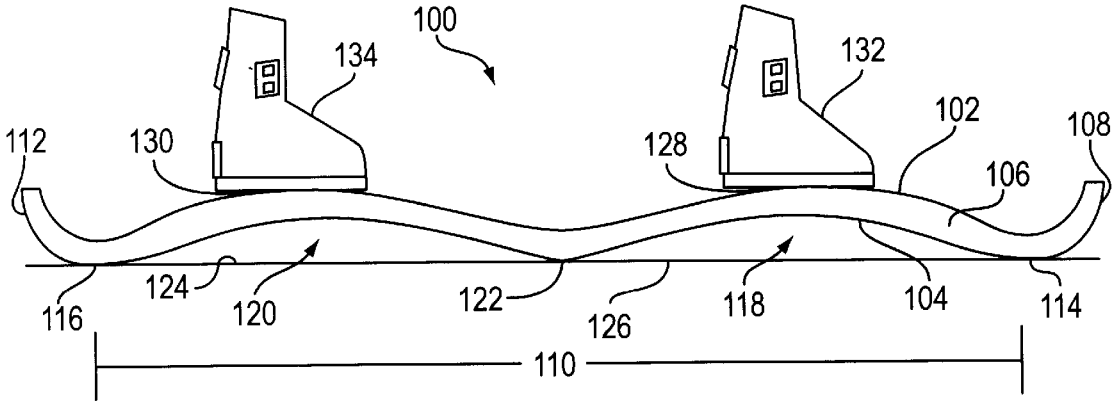
FIG. 3 is a diagrammatic side view of a snowboard illustrating the fundamental concepts of the present invention.
Figure 4:
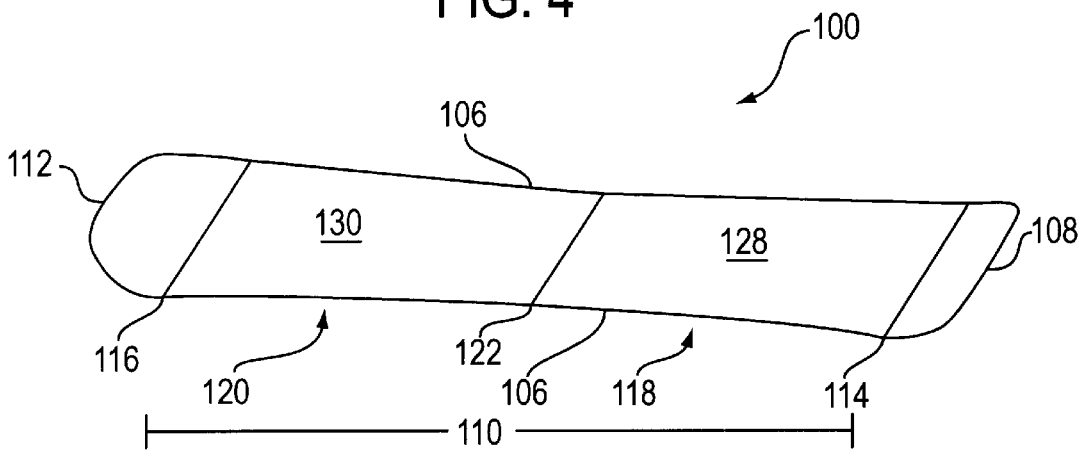
FIG. 4 is a perspective view of a preferred embodiment of a snowboard according to the present invention.
Figure 5:
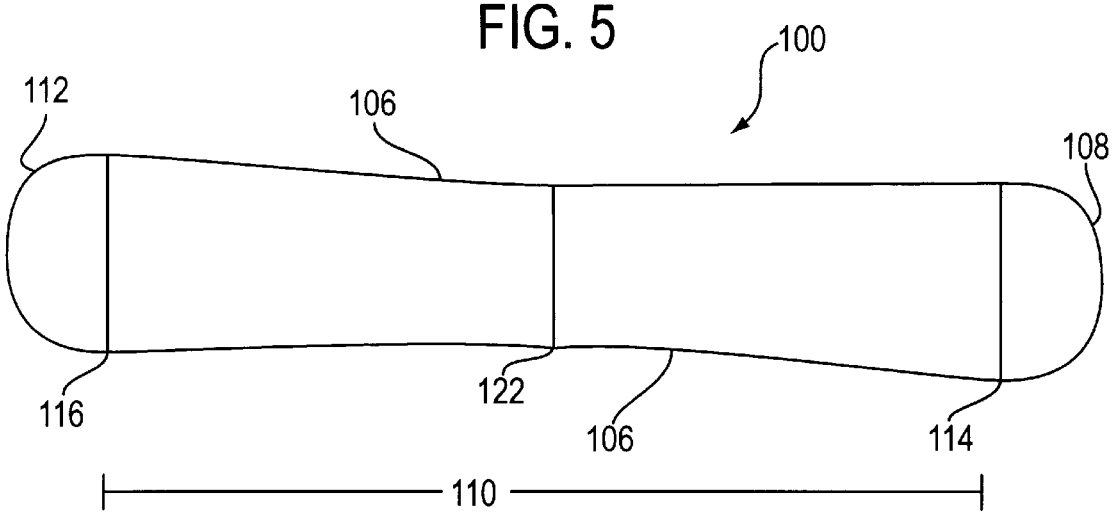
FIG. 5 is a top view of the snowboard of FIG. 4.
Figure 6:
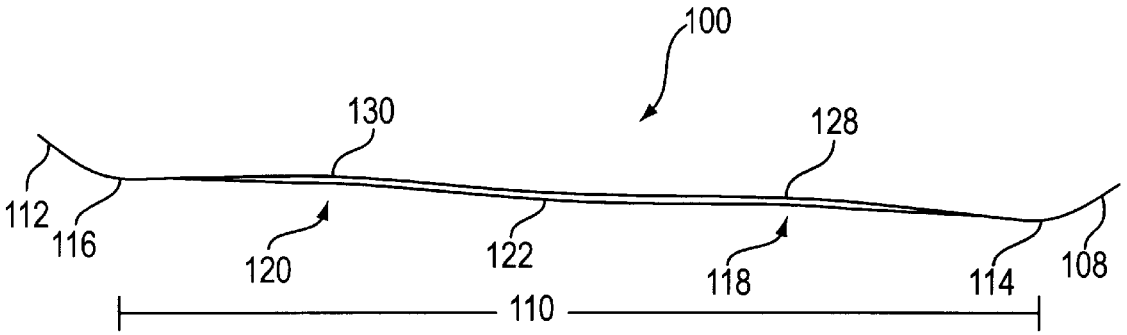
FIG. 6 is a side view of the snowboard of FIG. 4.

In accordance with the present invention, central section 110 includes a plurality of cambers or cambered portions, in this instance a pair of longitudinally spaced cambers 118 and 120, each having upwardly arched top and bottom portions which are separated by a third arcuate riding area a base portion 122 that is adapted to come into contact with the riding surface 124 during use by the user; see FIGS. 3 and 6. The upwardly arched top portions are convexly formed while the upwardly arched bottom portions are concavely formed. Snowboard 100 is adapted to ride on the surface 124 of snow 126 at the three arcuate riding areas 114, 116, and 122.

Snowboard 100 is divided into identifiable sections for ease in explanation. In practice, snowboard 100 is an integral structure from nose 108 to tail 112.

Located approximately centrally on the upwardly arched top portion of the top surface of cambers 118 and 120 are mounting zones 128 and 130, respectively. Boots 132 and 134 are affixed to mounting zones 128 and 130, respectively, by any known mounting means, including the aforementioned threaded inserts, bindings, etc. (not shown).

The functioning and principal advantages of snowboard 100 over prior art snowboards will now be discussed.

Figure 2:
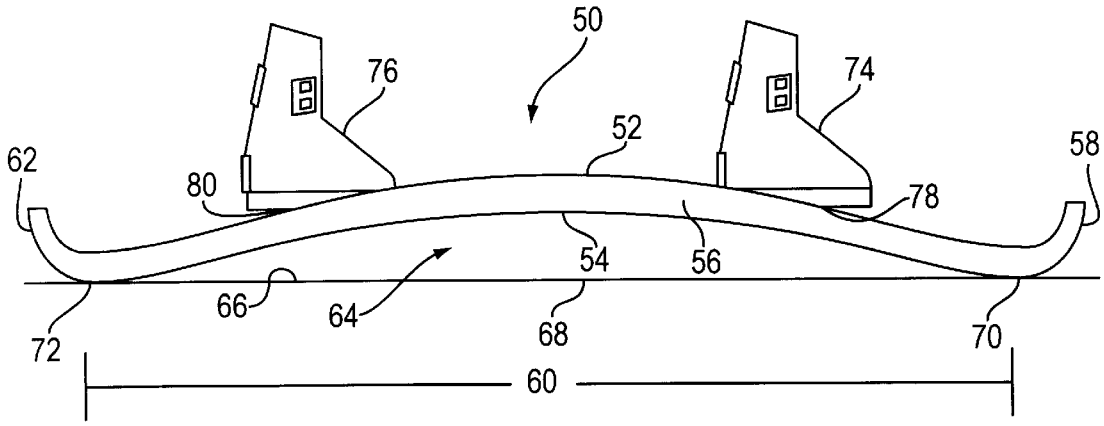
FIG. 2 PRIOR ART
FIG. 2 is a diagrammatic side view illustrating a prior art snowboard.

Each half of snowboard 100 closely resembles in form and function the equivalent of one ski per foot. Riding area 122 is in substantially constant touch with the snow 126, effectively quenching its capabilities for vibrating or transmitting vibrations from one camber to the other. Unlike the single camber of prior art snowboards, such as snowboard 50 of FIG. 2, which mixes the weight shifts into complex bending responses, providing a separate camber for each foot effectively limits the sphere of action of that foot to its associated camber which isolates the responses thereto to that one camber.

Individually, each half responds similar to ski 10 as well. Boot 132 is essentially centrally located over camber 118. Like the single foot supported by a single ski, camber 118 must respond to only one essentially symmetrically located input source, so the distribution of the forces is straightforward and direct. The respective cambered portion 118 and 120 is deflected downwardly toward riding surface 124 during use by the weight of a user. The presence of two cambers, instead of the one camber previously included in snowboards, effectively separates the response of snowboard 100 to variations in the weight shifts of each foot individually. An increase in weight applied to snowboard 100 over camber 118 through boot 132, by a longitudinal shifting of weight, will tend to flatten camber 118, but it has very little affect on camber 120. Each camber is smaller than camber 64 of snowboard 50, so any ripple effect created is not only minimized but essentially confined to the portion of snowboard 100 between arcuate riding areas 114 and 122. The same holds true for variations in the forces applied to boot 134.

When the rider leans his/her body forwardly or backwardly, it not only tilts the snowboard, it also applies torsioning forces to the snowboard, depending again upon the relative transverse weight distributions. Snowboard 100 assists in providing controllable, predictable results from these torsioning actions.

It is clear from the above that the objects of the invention have been fulfilled. The two camber construction of snowboard 100 greatly minimizes, if not virtually eliminates, vibrations and torques in the board.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the following Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It can be seen from the above that an invention has been disclosed which fulfills all the objects of the invention. It is to be understood, however, that obvious modifications of the present invention will be apparent to a person of ordinary skill in the art. Thus, within the scope of the appended claims, the invention may be practiced otherwise than as specifically described herein.

I claim as my invention:

1. A snowboard, comprising:

a nose portion, a tail portion, a base surface, a top surface, a central section extending longitudinally between said nose and tail portions, and a pair of mounting zones on said top surface adapted to mount a pair of boots to said central section, said central section including two longitudinally spaced, cambered portions each having upwardly arched top and bottom portions, each one of said pair of mounting zones being generally located on said upwardly arched top portion of said top surface of a respective one of said cambered portions so that the respective cambered portion is deflected downwardly toward a riding surface during use by the weight of a user, the nose portion and the tail portion having forward and rearward base surfaces, respectively, which are adapted to come into contact with said riding surface during use by the user, said central section having a base portion formed between said two cambered portions, said base portion adapted to come into contact with said riding surface during use by the user.

2. The snowboard as set forth in claim 1, wherein said upwardly arched top portions are each convexly formed and said upwardly arched bottom portions are each concavely formed.

3. The snowboard as set forth in claim 1, wherein each one of said pair of mounting zones is generally located approximately centrally on said upwardly arched top portion of said top surface of a respective one of said cambered portions.

4. The snowboard as set forth in claim 1, wherein said forward and rearward base surfaces each comprise arcuate riding areas.

5. The snowboard as set forth in claim 1, wherein said base portion formed between said two cambered portions comprises an arcuate riding area.

6. The snowboard as set forth in claim 1, wherein said base portion formed between said two cambered portions is in substantially constant touch with said riding surface during use by the user.

7. The snow board as set forth in claim 1, wherein said forward and rearward base surfaces comprise first and second arcuate riding areas, respectively, and wherein said base portion formed between said two cambered portions comprises a third arcuate riding area.

* * * * *